United States Patent [19]

Bodiford, Jr.

[11] Patent Number: 4,569,455

[45] Date of Patent: Feb. 11, 1986

[54] CENTERING DETENT

[75] Inventor: James E. Bodiford, Jr., Mansfield, Ohio

[73] Assignee: Harvey Hubbell Incorporated, Orange, Conn.

[21] Appl. No.: 596,644

[22] Filed: Apr. 4, 1984

[51] Int. Cl.[4] ..... B61G 7/12

[52] U.S. Cl. ..... 213/19; 213/20

[58] Field of Search ..... 213/19–21, 213/12, 18, 71, 72, 74; 280/477; 403/330; 74/532

[56] References Cited

U.S. PATENT DOCUMENTS

| | | | |
|---|---|---|---|
| 799,082 | 10/1905 | O'Connor . | |
| 802,465 | 3/1905 | Mitchell | 213/20 |
| 802,469 | 9/1905 | O'Connor | 213/20 |
| 829,731 | 11/1906 | O'Connor | 213/20 |
| 925,167 | 7/1909 | Forsyth . | |
| 950,488 | 1/1910 | Matthews . | |
| 950,489 | 4/1910 | Matthews | 213/20 |
| 1,124,032 | 6/1915 | Künzi | 213/20 |
| 1,126,979 | 3/1915 | Gilbert | 213/20 |
| 1,148,006 | 7/1915 | Bradford et al. . | |
| 1,149,662 | 9/1915 | McCord . | |
| 1,234,617 | 4/1917 | Bradford et al. . | |
| 1,311,699 | 12/1919 | Kelso . | |
| 1,346,545 | 7/1920 | Kelso . | |
| 1,400,210 | 10/1921 | Buhoup | 213/20 |
| 1,632,942 | 11/1927 | Alma et al. | 213/20 |
| 1,707,155 | 4/1929 | Alma et al. . | |
| 2,003,221 | 10/1935 | Regan et al. | 213/71 |
| 2,171,343 | 9/1939 | Olcsvary | 213/20 |
| 2,235,618 | 5/1941 | Larsson | 213/62 |
| 2,545,330 | 7/1951 | Wolfe | 213/71 |
| 2,754,978 | 6/1956 | Metzger | 213/20 |
| 2,832,476 | 3/1958 | Metzger | 213/19 |
| 3,349,926 | 11/1967 | Cope | 213/16 |
| 3,484,000 | 4/1969 | Cope | 213/20 |
| 3,561,612 | 5/1971 | LaBoda | 213/20 |
| 3,578,180 | 4/1971 | Metzger et al. | 213/20 |
| 4,289,247 | 7/1981 | Brand et al. | 213/20 |

FOREIGN PATENT DOCUMENTS

| | | | |
|---|---|---|---|
| 0558921 | 1/1931 | Fed. Rep. of Germany | 280/477 |
| 1122568 | 1/1962 | Fed. Rep. of Germany | 213/21 |
| 0022621 | of 1911 | United Kingdom | 213/20 |

*Primary Examiner*—Randolph A. Reese

*Attorney, Agent, or Firm*—Jerry M. Presson; Walter C. Farley

[57] ABSTRACT

A detent apparatus for maintaining a draw bar in a centered position includes an indentation formed in a cylindrical surface of the pivotable taileye of the draw bar structure. A roller is arranged to ride along the surface and into the indentation, the roller being urged into the indentation by symmetrically arranged levers, pivoted as first class levers, with the inner, shorter arm of each lever urging the roller and the outer arm being urged by compression coil springs which are seated on the anchorage structure attached to a railroad car.

6 Claims, 7 Drawing Figures

CENTERING DETENT

This invention relates to positioning apparatus for a draw bar or coupler system on a railroad car and particularly to a detent apparatus for keeping the coupler centered.

BACKGROUND OF THE INVENTION

When the draw bar of a railroad car, such as a transit car, is not attached to another car and is therefore unused for a period of time while the car itself is being used, the draw bar apparatus can swing freely about its normal vertical pivot axis unless a restraint system is provided. After a period of non-use, the draw bar can end up in any of a variety of positions, unpredictably, thus complicating the task of coupling that draw bar to another. Although various gathering devices have been developed, none can accommodate the possible extremes in combinations of draw bar position and track curvature which can occur.

For this reason, various centering devices have been developed. Generally, these devices use some combination of springs with levers, cam surfaces or torque systems to urge the draw bar toward its central position. It is characteristic of these that the restoring force on the draw bar be exerted whenever the draw bar departs significantly from its center position and that force usually increases as the angular departure from center increases.

While these devices work well on an unused draw bar, they are not removed or deactivated when the draw bar is coupled to another car and, therefore, continue to exert a restraining or restoring force on the draw bar as the coupled cars pass around a curve. This is an undesirable situation because desirable angular movement is impeded.

BRIEF SUMMARY OF THE INVENTION

An object of the present invention is to provide a detent apparatus which operates when the draw bar system is moved to its centered position to keep the draw bar centered as long as the coupler is not attached to that of another car but which exerts no restoring or centering force after the draw bar system has been swung away from center.

A further object is to provide such an apparatus in which the force supplied by the detent latch is sufficient to keep the draw bar and coupler mass from leaving center under normal, detached operating conditions, this force being small compared with that exerted by another car when the coupler is attached.

A still further object is to provide such an apparatus which can be installed on an existing draw bar and coupler structure without extensive modification of the existing structure and which can be removed therefrom with a minimum of tools and without disturbing other parts of the mounted coupler system.

Briefly described, the invention is applied in the context of a transit car draw bar system of the type including anchorage means attached to the car, a taileye member pivotably connected at one end to the anchorage means for pivotal movement about a generally vertical axis and mechanical coupler means attached to the taileye member for engagement to similar coupler means on another car. The invention itself comprises a centering detent structure which includes a cylindrical surface formed on the pivotably connected end of the taileye member, the surface being generally convex and facing toward the anchorage means and the car, the surface having an indentation formed at a predetermined angular position relative to the longitudinal axis of the taileye member. A roller is shaped and dimensioned to engage the indentation and is mounted on a support attached to the anchorage means, the roller being rotatable about a translatable vertical axis. The structure further includes means for urging the roller into engagement with the indentation when the longitudinal axis of the taileye member is positioned so that the roller and indentation are aligned such that the roller exerts a force tending to maintain the taileye in that position, the roller being such that it rides on the cylindrical surface and exerts no significant restoring force when the axis of the taileye is angularly separated from the position enough to cause the roller to be disengaged from the indentation.

As will be recognized, the term "anchorage means" is used herein in the rather generic sense of a structure fastened to major structural portions of the railroad car to which coupling devices are attachable so that the car can be pulled by, or can exert a pulling force on, another car. Similarly, the terms "taileye" and "coupler" are used in the broad meanings of hinged or pivotable devices for interconnecting the anchorage means with a coupler of any type engageable with a mating device on another car.

BRIEF DESCRIPTION OF THE DRAWINGS

In order that the manner in which the foregoing and other objects are obtained in accordance with the invention can be understood in detail, particularly advantageous embodiments thereof will be described with reference to the accompanying drawings, which form a part of this specification, and wherein.

DETAILED DESCRIPTION OF A PREFERRED EMBODIMENT

Figure 1:
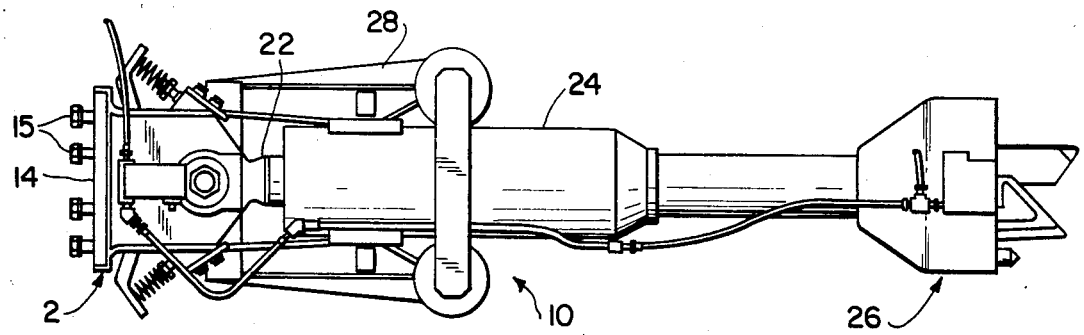
FIG. 1 is a simplified top plan view of a draw bar system including a detent apparatus in accordance with the invention.
Figure 2:
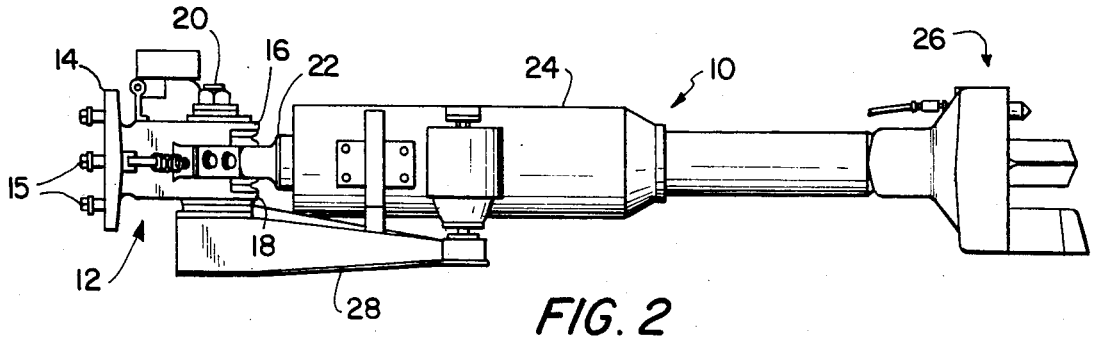
FIG. 2 is a side elevation of the apparatus of FIG. 1.

Referring now to the drawings in detail, it will be seen that FIGS. 1 and 2 show a draw bar system indicated generally at 10 which is one example of a system to which the invention can be applied. At one end is an anchorage means 12 which has an end plate 14 for attachment to the structural portions of a railroad car using fasteners such as threaded bolts 15. The anchorage means includes outwardly extending portions 16 and 18 forming a clevis through which a pivot bolt 20 extends, defining a generally vertical pivot axis. A taileye piece 22 has an eye at one end through which bolt 20 passes, with suitable bushings, in a conventional manner so that the taileye is pivotable in a generally horizontal plane about the axis of bolt 20. The taileye is also movable in a vertical plane through a limited angle.

Taileye 22 is coupled to an intermediate structure 24, the other end of which is connected to a coupling indicated generally at 26 by which the draw bar system is connected to another car. A support structure 28 is connected between the anchorage means and the intermediate structure for the purpose of supporting the draw bar system and permitting limited vertical motion. The support structure, intermediate structure, and mechanical coupler, while necessary for the overall operation of the draw bar system, are not directly part of the present invention and are conventional and will therefore not be described in any further detail.

Figure 3:
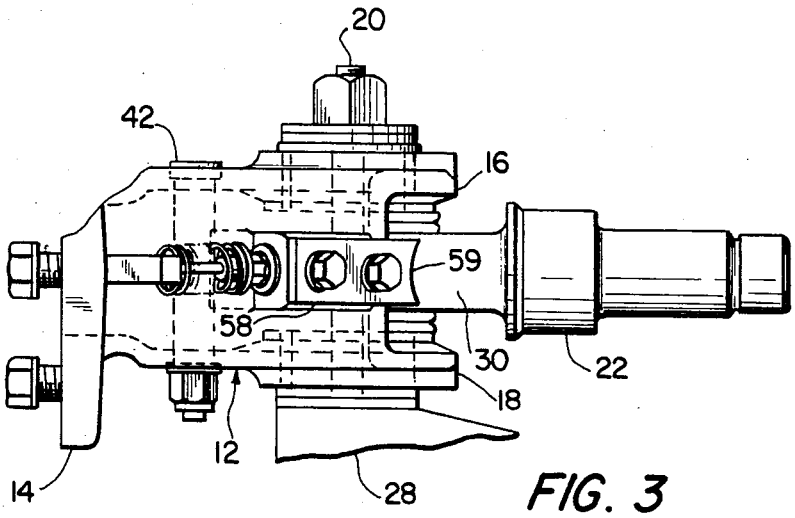
FIG. 3 is an enlarged side elevation of the anchorage end of the draw bar system shown in FIG. 1.
Figure 4:
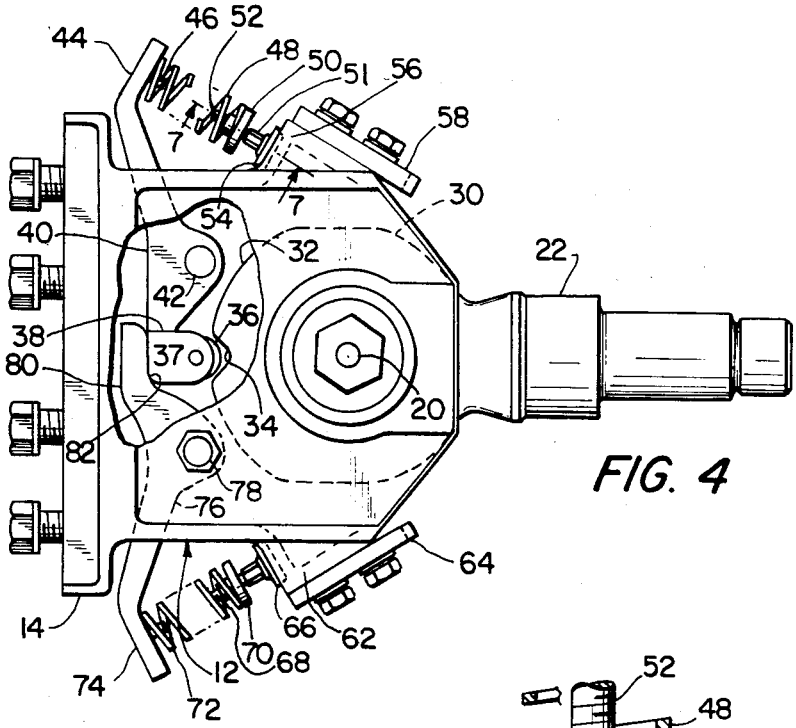
FIG. 4 is a top plan view of the apparatus of FIG. 3.

The portion of the apparatus in the vicinity of anchorage means 12 is shown in enlarged form in FIGS. 3 and 4 in which the operation of the invention can be more readily seen. As is best seen in FIG. 4, the taileye member has an enlarged end 30 with a generally cylindrical end surface 32 which faces in the direction of the car. Surface 32 is a portion of a cylindrical surface, a cylinder being defined as a surface formed by a line moving parallel with itself along a closed path. A portion of this cylindrical surface is formed as an indentation 34, the indentation being concave and the remaining portions of surface 32 on either side thereof being outwardly convex. When the longitudinal axis of taileye 22 is generally perpendicular with the base of anchorage means 12, in which position the axis of the taileye is normally aligned with the longitudinal axis of the car to which it is connected, indentation 34 lies also on that axis in the embodiment shown. It is preferable that the portions of surface 32 which lie on either side of the indentation form portions of a circular cylinder centered at the central axis of bolt 20, these surfaces being so formed in the embodiment of FIGS. 3 and 4 to the extent of angular motion through which taileye 22 can move, about 52° either side of center.

Figure 6:
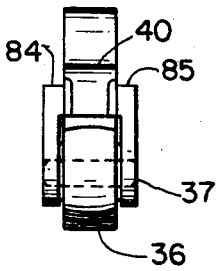
FIG. 6 is an end elevation of the portion of FIG. 5.
Figure 5:
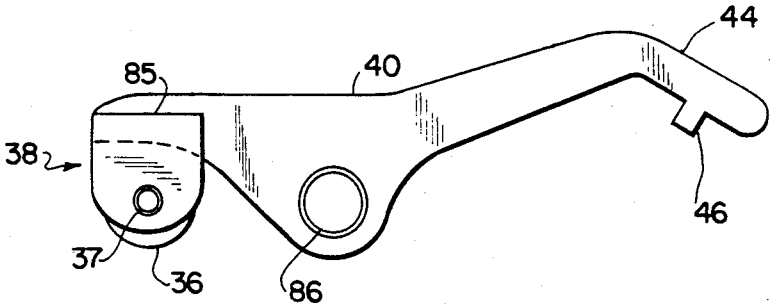
FIG. 5 is a top plan view of a portion of the detent structure of the apparatus in FIGS. 1–4.

A roller 36, which is shaped and dimensioned to engage indentation 34 by partially entering it, is supported in a small clevis 38 which is fixedly attached to a lever 40, separately shown in FIGS. 5 and 6. Lever 40 is pivotably movable about a pivot pin 42 which is mounted in anchorage means 12. Roller 36 is rotatable about an axle 37 in clevis 38, the distance between the center of rotation of axle 37 and the pivot center of pin 42 defining an arm which can be regarded as the shorter arm of a first class lever fulcrummed at 42. The longer arm thereof extends in the opposite direction and ends at a spring support plate 44 having an inwardly extending guide pin 46 which protrudes into the center of a compression coil spring 48, the other end of which abuts an adjustment stop nut 50. Nut 50 rides on a threaded stud 52, the position of the nut thereon being adjustable to control the force applied by spring 48.

As will be recognized, spring 48 urges support plate 44 of lever 40 outwardly, or to the left in FIG. 4, tending to pivot the lever about pin 42 and urge roller 36 against surface 32 and, when taileye 22 is aligned as illustrated, into indentation 34.

Bolt 52 is mounted in a bearing structure 54 which is supported in a protruding support member 56 of the casting or forging forming the anchorage means. A stop plate 58 having an arcuately curved end portion 59 is mounted on protrusion 56 by threaded fasteners, the curved end portion forming a limit stop against which tail piece 22 abuts at its limit of motion. At that point, roller 36 is approximately at the end of the circular portion of surface 32.

At the other side of anchorage means 12 is a similar protrusion 62 supporting a stop plate 64 which provides the limit stop in the opposite direction, protrusion 62 also supporting a bearing 66 which receives a threaded stud 68 supporting a stop nut 70 against which one end of a compression coil spring 72 rests. The other end of spring 72 presses outwardly against a support plate 74 at the end of a lever 76 which pivots about a pivot pin 78 supported in anchorage means 12, lever 76 being somewhat similar in shape to lever 40 but having no roller attached thereto and having a somewhat different function. Lever 76 has a short end 80 with a surface 82 which is shaped to smoothly abut the back surface of the short end of lever 40 behind the clevis supporting roller 36. Thus, as spring 72 presses support plate 74 on the long arm of lever 76 outwardly, surface 82 is pressed against the end portion of the short arm of lever 40, further urging the roller 36 against surface 32 and into the indentation.

With the structure illustrated in FIG. 4, springs 48 and 72, which are of reasonable size so as to be accommodated in spaces closely adjacent the lateral sides of anchorage means 12, are both applying force against axle 37 to press roller 36 into indentation 34. Thus, somewhat smaller springs can be used than would be required if a spring were pressing directly, for example, between the inner surface of plate 14 and a roller-carrying structure. Additionally, the levers provide a mechanical advantage because the springs press against arms which are longer than the short arms between pins 42 and 78 and axle 37.

Furthermore, the spring force is adjustable by movement of nuts 50, 70 along studs 52, 68. It will be observed that when the taileye is aligned as shown, the roller acts against the indentation sides to inhibit movement of the draw bar assembly. However, when sufficient angular force is applied to the draw bar system, so as to cause roller 36 to roll out of indentation 34 and along the remaining portion of surface 32, the roller supplies substantially no force against the taileye or the remaining system. While there is some rolling frictional force, this is relatively small and it is a radial force which is easily absorbed by the bushings surrounding bolt 20 and the inside of the opening through eye 30 and does not constitute a restoring force which would tend to return the taileye toward center.

As previously mentioned, the structural details of lever 40 are more clearly shown in FIGS. 5 and 6, pin 46 being provided to keep the spring from moving laterally should the compressive force be inadvertently removed. Pin 46 is of adequate length to prevent detachment of spring 48 from support plate 44 for all positions of nut 50. This constitutes a safety measure for all conditions including an inadvertent failure to adjust. The clevis structure 38 includes plates 84 and 85 which carry axle 37 about which roller 36 rotates.

Figure 7:
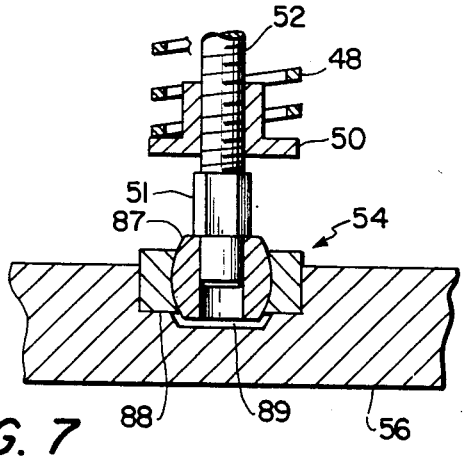
FIG. 7 is an enlarged partial side elevation along line 7—7 of FIG. 4.

A further feature of the apparatus is shown in FIG. 7 which illustrates, in enlarged form, the details of bearing 54 which support the inner end of stud 52 along which stop nut 50 is adjustable. As will be recognized, the unthreaded end of stud 52 is inserted into a generally spherical bearing member 87 which is received in a mating spherical recess in a bearing member 88 which is received in a recess 89 formed in a wall of protrusion 56. Recess 89 is machined into the wall of protrusion 56 sufficiently large so that bearing 87 is capable of unrestricted movement. Stud 52 extends well into the interior of spring 48 to assure alignment of the spring and to provide a significant length of adjustment for nut 50. A second adjustment member 51 is formed on stud 52, providing a shoulder which rests against spherical bearing member 87.

As lever 40 moves, the angular relationship between the interface of support plate 44 and the outer face of protrusion 56 do not remain parallel. The spherical bearing arrangement illustrated in FIG. 7 permits the stud to remain aligned with the spring through these changes in angular relationship so that there is no loss of spring force by bending which would create unused lateral components of force. The free length (uncompressed) of spring 48 is chosen to generally be adequate to rotate lever 40 to its limit of travel almost without regard for the position of nut 50. Thus, any adjustment of nut 50 toward the lever simply compresses the spring without moving support plate 44 or causing any change in the angular orientation of spring 48. The structure supporting stud 68 is the same.

It will be recognized that other arrangements can be provided to support axle 37 so that the axle is appropriately translatable parallel with itself to permit roller 36 to move into and out of engagement with recess 34. Indeed, it is quite possible to position the components so that they are not symmetrically located as illustrated in FIG. 4, but are, instead, disposed to one side or the other of a centerline passing through anchorage means 12. In this case, the indentation would also be offset from the center line of the taileye so that the engagement between roller 36 and the indentation would still result in positioning the taileye along the desired axis. However, the arrangement of components as illustrated in FIG. 4 permits simple configuration of the anchorage means and symmetrical distribution of the forces which is believed to be the most advantageous and simplest arrangement. This arrangement also makes symmetric or balanced adjustment of springs 48 and 72 unnecessary. Because of the features of the structure, the angular force required to displace taileye 22 in one direction from its center position is equivalent to the force required to rotate it from center in the other direction without regard to balance between the adjusted forces supplied by springs 48 and 72.

The movement of the levers is small and the arm contains a self-lubricating bearing 86 so that the armpin interface requires no lubrication. Preferably, the taileye surface 32 which is encountered by the roller, including notch 34, are covered with a flame-sprayed hard facing alloy to minimize wear. The surfaces defining the intersections between concave and convex portions thereof are smoothly contoured to similarly minimize wear and undesirable resistance to motion, the taileye breakout force being precisely determined by the adjustment of the spring preload in springs 48 and 72. It is desirable that the same breakout force is established in both directions, this force being small compared with that exerted by another car coupled to coupler 26. For a typical coupler assembly, the spring force is adjusted so that a lateral force of between about 110 lbs. and about 130 lbs. must be exerted at the face of coupler 26 to cause roller 36 to leave indentation 34. The lengths of springs 48, 72 should be between about 2.5 inches and 3.0 inches.

While one advantageous embodiment has been chosen to illustrate the invention, it will be understood by those skilled in the art that various changes and modifications can be made therein without departing from the scope of the invention as defined in the appended claims.

What is claimed is:

1. A centering detent structure for use with a transit car draw bar system of the type including anchorage means attached to the car, a taileye member pivotably connected at one end to the anchorage means for pivotal movement about generally vertical axis and mechanical coupler means attached to the taileye member, the detent structure comprising;

means at the pivotably connected end of the taileye member defining a cylindrical, generally convex surface facing generally toward the anchorage means, said surface including an indentation in said surface at a predetermined angular position relative to the longitudinal axis of said taileye member;

a roller shaped and dimensioned to engage said indentation;

means on said anchorage means for supporting said roller for rotation about a translatable vertical axis; and means for urging said roller into engagement with said indentation when the longitudinal axis of said taileye member is positioned with said roller and indentation aligned so that said roller exerts a force tending to maintain said taileye in said position and to exert no restoring force when the axis of said taileye is angularly separated from said position, said means for supporting and urging said roller including;

a first first class lever having arms of unequal lengths and having said roller rotatably mounted near the end of the short arm thereof;

a second first class lever having arms of unequal lengths and having the short arm thereof against said short arm of said first lever; and first and second spring means acting against the long arms of said first and second levers to urge said levers in a direction to press said roller toward said cylindricial surface.

2. A detent structure according to claim 1 wherein said roller is positioned substantially along the longitudinal axis of said car and said roller and indentation are aligned when the axis of said taileye is substantially aligned with said car axis.

3. A detent structure according to claim 1 wherein each of said spring means comprises a compression coil spring.

4. A detent structure according to claim 3 which further includes adjustment means at the end of each of said springs adjacent said anchorage, said adjustment means including a threaded rod having an adjustment nut thereon, and wherein said said anchorage includes a protruding support member on each side to support an end of said threaded rod and a spherical bearing between the end of each said rod and its support member to permit automatic angular adjustment thereof.

5. A detent structure according to claim 1 wherein said roller and indentation are aligned when the axis of said taileye is substantially aligned with said car axis.

6. A centering detent structure for use with a transit car draw bar system of the type including anchorage means attached to the car, a taileye member pivotably connected at one end to the anchorage means for pivotal movement about a generally vertical axis and mechanical coupler means attached to the taileye member, the detent structure comprising;

means at the pivotably connected end of the taileye member defining a cylindrical, generally convex surface facing generally toward the anchorage means, said surface including an indentation in said surface at a predetermined angular position relative to the longitudinal axis of said taileye member;

a roller shaped and dimensioned to engage said indentation;

means on said anchorage means for supporting said roller for rotation about a translatable vertical axis, said means for supporting said roller including;

a first lever pivotably mounted on the anchorage for motion about a generally vertical fulcrum axis, said first lever having a short arm extending across the centerline of said anchorage and a longer arm extending outwardly of said anchorage, said roller being supported on said short arm; and a second lever pivotably mounted on the anchorage for motion about a second generally vertical fulcrum axis on the opposite side of said anchorage from said first axis, said second lever having a short arm extending across said centerline and lying adjacent said short arm of said first lever, and a longer arm extending outwardly of said anchorage; and means for urging roller into engagement with said indentation when the longitudinal axis of said taileye member is positioned with said roller and indentation aligned so that said roller exerts a force tending to maintain said taileye in said position and to exert no restoring force when the axis of said taileye is angularly separated from said position, said means for urging including;

first and second compression coil springs extending between positions near the ends of said first and second levers, respectively, and said anchorage to exert a force on said first lever tending to urge said roller against said surface and to exert a force on said second lever tending to urge the short arm thereof against said first lever to assist the force thereon.

* * * * *